United States Patent [19]

Marschak

[11] Patent Number: 4,646,656

[45] Date of Patent: Mar. 3, 1987

[54] BASE SHELF LOCKING MECHANISM

[76] Inventor: Howard J. Marschak, 2030 Silvertip La., Long Beach, Ind. 46360

[21] Appl. No.: 780,330

[22] Filed: Sep. 26, 1985

[51] Int. Cl.[4] ..... A47B 9/00

[52] U.S. Cl. ..... 108/108; 108/111; 211/153

[58] Field of Search ..... 108/108, 107, 110, 111, 108/152; 312/257 SM, 257 R, 263; 248/247, 250; 292/302, 300; 211/135, 153

[56] References Cited

U.S. PATENT DOCUMENTS

| | | | |
|---|---|---|---|
| 2,958,427 | 11/1960 | Bianchi | 108/108 |
| 3,040,905 | 6/1962 | Gingher et al. | 108/108 |
| 3,216,377 | 11/1965 | Gunn | 108/108 |
| 3,469,711 | 9/1969 | Swaneck et al. | 108/108 X |
| 3,480,345 | 11/1969 | Torok | 312/257 R |
| 3,545,712 | 12/1970 | Ellis | 108/152 X |
| 3,602,159 | 8/1971 | Marschak | 108/111 |
| 3,669,036 | 6/1972 | Marschak | 108/111 X |
| 4,173,379 | 11/1979 | van der Heiden et al. | 312/330 SM |
| 4,408,812 | 10/1983 | Krautwurst | 108/108 X |
| 4,549,665 | 10/1985 | Smitley | 108/111 X |

FOREIGN PATENT DOCUMENTS

| | | | |
|---|---|---|---|
| 1557188 | 12/1979 | United Kingdom | 108/108 |
| 2071995 | 9/1981 | United Kingdom | 312/330 SM |

*Primary Examiner*—Kenneth J. Dorner
*Assistant Examiner*—José V. Chen
*Attorney, Agent, or Firm*—Emrich & Dithmar

[57] ABSTRACT

A merchandise display of two upstanding standards each forming a longitudinally extending slot positioned so that the slots face each other with two bottom side members each connected to one of the standards and extending forwardly therefrom, each of the bottom side members having a front end and a retaining member near the front end. A shelf having means engaging the retaining member on each of the side members and having a ledge at the rear thereof disposed between the standards, a panel connecting the front ends of the bottom side members and an apertured board slidably held in the slots in the standards resting on the ledge.

10 Claims, 7 Drawing Figures

BASE SHELF LOCKING MECHANISM

BACKGROUND OF THE INVENTION

A display used to display merchandise must be inexpensive yet of relatively sturdy construction in order that a great many items can be displayed while at the same time withstanding the abuse to which they are subjected. The display should be constructed such that commodities are retained in a predetermined spaced relationship. Usually the display units have a large section of apertured board commonly known as Pegboard on which to hang the articles to be displayed. This is important since the displayed articles should conveniently be present in sufficient quantities so that stocking and restocking problems are alleviated by having a sufficiently large number of the displayed commodities mounted on the apertured board. A common problem with merchandise displays of the type described is that the apertured board which may conveniently rest on the bottom shelf of the display unit is heavy which causes the bottom panel to rotate upwardly thereby causing merchandise to spill and resulting in an unstable construction.

SUMMARY OF THE INVENTION

This invention relates to a merchandise display unit in which a pair of posts or standards hold an apertured board which rests on a bottom shelf and more particularly this invention relates to mechanism and construction for retaining the bottom shelf in place irrespective of the weight of the apertured board or the units of merchandise displayed thereon.

A principal object of the present invention is to provide a merchandise display comprising two upstanding standards each forming a longitudinally extending slot positioned so that the slots face each other, two bottom side members each connected to one of the standards and extending forwardly therefrom, each of the bottom side members having a front end and a retaining member near the front end, a panel connecting the front ends of the bottom side members, a shelf having means engaging the retaining member on each of the side members and having a ledge at the rear thereof disposed between the pair of standards, and an apertured board slidably held in the slots in the standards resting on the ledge, whereby the shelf supports the weight of the apertured board and is maintained in place on the side members by the engagement of the retaining members and the shelf.

Another object of the present invention is to provide a merchandise display comprising two upstanding standards each forming a longitudinally extending slot, the standards facing each other so that the slots are in registry, two bottom side members each having a rear portion connected to one of the standards and extending forwardly therefrom terminating in a front end, a shelf resting on each of the side members having a ledge at the rear thereof disposed between the standards, an apertured board slidably held in the slots in the standards resting on the ledge, and means near the front of the side members for retaining the shelf in resting position on the side members, whereby the shelf supports the weight of the apertured board at the rear of the shelf and is maintained in position on the side members by the retaining means.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE PREFERRED EMBODIMENT

Figure 1:
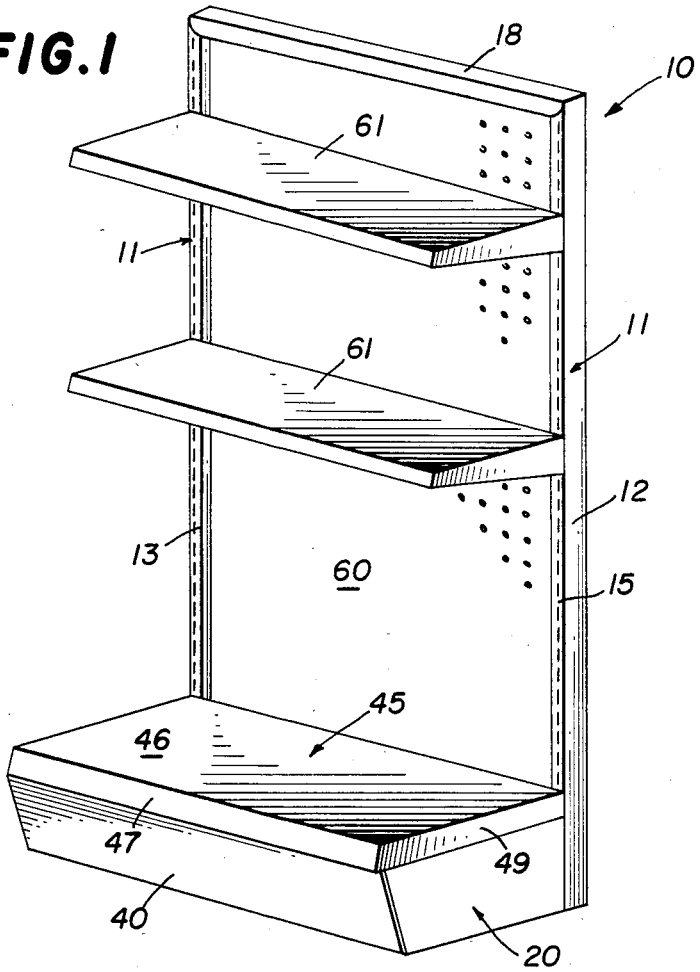
FIG. 1 is a perspective view of a merchandise display unit incorporating the invention.

Referring now to the drawings, there is illustrated a merchandise display unit 10 comprised of a pair of upstanding standards 11 each having an outer side surface 12, a front surface 13, and a rear surface 14. The front surface 13 has a plurality of longitudinally spaced apart slots 15, and each of the standards 11 forms in transverse cross section a C-shaped member which has a longitudinally extending slot 16. The standards 11 are positioned such that the longitudinally extending slots 16 are facing each other and are in registry. The standards 11 are connected by a top member 18 in any manner which may be convenient such as by metal screws or the like. Preferably, each of the standards 11 is made from a single piece of sheet metal bent in the manner described to form the standard.

Figure 7:
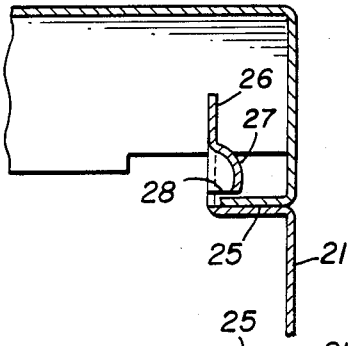
FIG. 7 is a view in cross section of the structure illustrated in FIG. 6 as seen along line 7—7 thereof.
Figure 6:
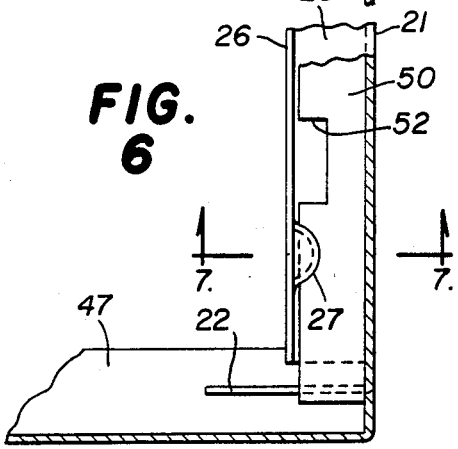
FIG. 6 is a view of the bottom shelf moved rearwardly with respect to the position illustrated in FIG. 5 showing the shelf in a locked position.
Figure 2:
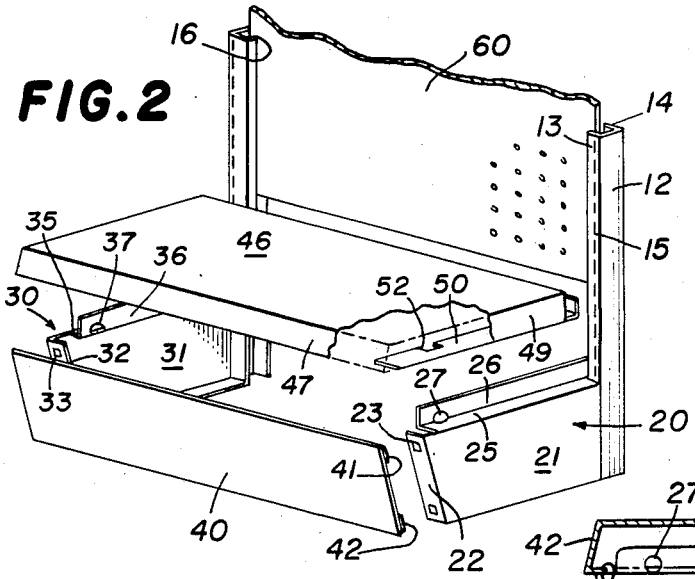
FIG. 2 is an exploded perspective view of the bottom portion of the display unit illustrated in FIG. 1.
Figure 3:
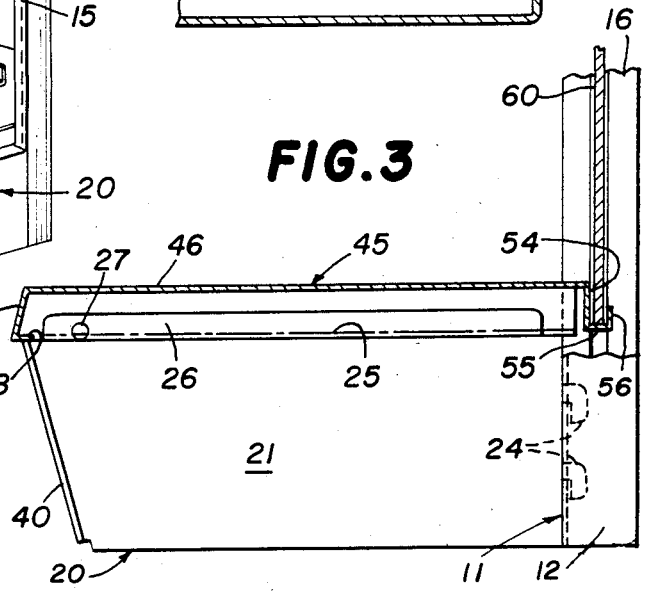
FIG. 3 is a side elevational view partly in section and partly broken away of the bottom portion of the display unit illustrated in FIG. 1.
Figure 4:
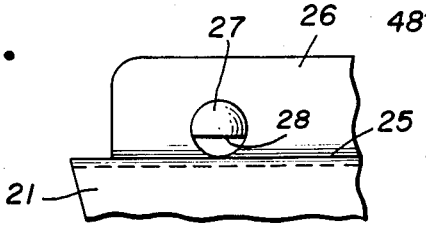
FIG. 4 is an enlarged sectional view of a portion of the display unit illustrated in FIG. 3 particularly showing the retaining member thereon.

The standards 11 are connected at the bottoms thereof respectively to bottom side member 20 and bottom side member 30. As seen in the drawings, the right hand standard is connected to the bottom side member 20 and the left hand standard is connected to the bottom side member 30. Referring now to the bottom side member 20, it is formed, preferably, from a single piece of sheet metal and has a side sheet 21 which has a front mounting flange 22 bent inwardly from the side 21, the front mounting flange 22 having a pair of vertically aligned apertures 23. The bottom side member 20 has a pair of mounting hooks 24 extending rearwardly thereof, see FIG. 3, for connection to the appropriate slots 15 in the right-hand standard 11, as seen in FIGS. 1-3. The bottom side member 20 has an inwardly extending flange 25 at the top edge of the side sheet 21 providing a horizontal surface and an upwardly extending flange 26 providing a vertical surface from which a detent 27 is punched outwardly toward the side of the display 10, the detent 27 having a trapping surface 28 as best seen in FIG. 7. The rear edge of the flange 26 is arcuate and terminates forwardly of the standard 11, as seen in FIG. 2.

The bottom side member 30 is a mirror image of the bottom side edge 20 and formed of a side 31 having a front mounting flange 32 provided with a pair of vertically aligned apertures 33. The bottom side member 30 has an inwardly extending flange 35 providing a horizontal surface and an upwardly extending flange 36 providing a vertical surface. A detent 37 is punched outwardly from the vertical surface of the flange 36 and provides a trapping surface the same as the surface 28 of the detent 27.

A front kick plate 40 is connected to the two front mounting flanges 22 and 32 of the bottom side members 20, 30 respectively, the front kick place 40 having inturned and overlapping ends 41 and 42 which receive the associated front mounting flange 22 and 32 so as to mount the front kick plate 40 to the bottom side members 20 and 30. A bottom shelf 45 has a top surface 46 and a front end surface 47 formed of a downwardly extending flange which has an inwardly extending lip 48. The bottom shelf 45 also has a pair of downwardly extending sides 49 each of which has an inwardly extending flange 50 in which a notch 52 is positioned near the front of the shelf 45. The shelf 45 also has a back wall 54, see FIG. 3, which extends downwardly and then is bent into an outwardly extending ledge 55 and upwardly extending retaining flange 56. The outwardly extending ledge 55 and the upwardly extending retaining flange 56 do not extend all the way to the sides 49 but are set inwardly so as to readily be received within the space between the standards 11.

Figure 5:
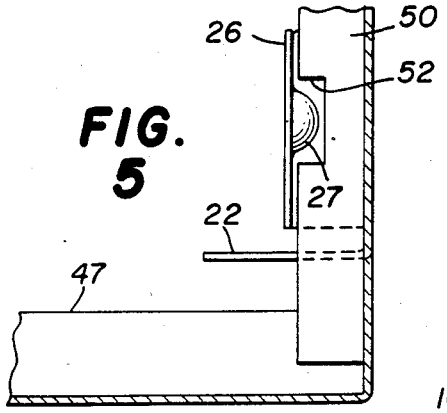
FIG. 5 is a top plan view of a portion of the bottom shelf with a part of the top broken away as illustrated in FIG. 2 showing the bottom shelf in position to be mounted on the side member.

The shelf 45 is positioned on the bottom side members 20 and 30 particularly with the inwardly extending flange 50 on top of the horizontal surface of the flange 25 with the two notches 52 positioned over the detents 27 and 37. This position is illustrated in FIG. 5. Thereafter the shelf 45 is moved rearwardly so that the ledge 55 is positioned in registry with the slots 16 in the standards 11. At the same time, rearward movement of the shelf 45 positions the flange 50 underneath the trapping surface 28 of the detent 27 and the other trapping surface of the detent 37, thereby to lock the front end of the shelf 45 against upward movement by means of the snug fit of the detents 37 and 27 with the forward end of the flanges 50. Thereafter, an apertured board 60 commonly known as a Pegboard is provided as a rear wall, it being understood that the apertured board 60 is inserted into the slot 17 and comes to rest on the ledge 55 as shown best in FIG. 3 before the top member 18 is put into place. Thereafter, a plurality of shelves 61 may be positioned on the standards 11 in any manner by use of mounting means such as illustrated for the bottom side members 20, 30.

In use, the weight of the apertured board 60 is such that there is a tendency for the shelf 45 to be moved upwardly away from the bottom construction but in the present invention, the combination of the detents 27, 37 with the trapping surfaces thereof and the inwardly extending flanges 50 provide a secure arrangement whereby irrespective of the amount of weight of the apertured board 60, no upward movement of the shelf 45 can occur. It should be remembered, that the standards 11 are made of single piece of sheet metal as are the bottom side members 20 and 30 as well as the front kick plate 40 and the bottom shelf 45. This provides a superior construction easily assembled along with greater strength for the unit.

While there has been described what at present is considered to the preferred embodiments of the invention, it will be understood to those skilled in the art that no modifications or alterations may be made therein without departing from the true spirit and scope of the invention and it is intended to cover in the claims appended hereto all such modifications and alterations.

I claim:

1. A merchandise display comprising two upstanding standards each forming a longitudinally extending slot positioned so that the slots face each other, two bottom side members each connected to one of said standards and extending forwardly therefrom, each of said bottom side members having a front end and a retaining member near said front end, a panel connecting the front ends of said bottom side members, a shelf having means engaging said retaining member on each of said side members and having a ledge at the rear thereof disposed between said pair of standards, each of said bottom side members has an inwardly extending flange and an upwardly extending flange forming a horizontal surface and a verticle surface for supporting said shelf, said retaining member being a detent extending from said vertical surface a short distance above said horizontal surface, said shelf having a pair of inwardly extending flanges each of which rests on said horizontal surface of the associated bottom side member and is retained against upward movement by the associated detent which extends above said horizontal surface to trap said flange against said bottom side member, and an apertured board slidably held in the slots in said standards resting on said ledge, whereby said shelf supports the weight of said apertured board and is maintained in place on said side members by the engagement of said retaining members and said shelf.

2. The merchandise display of claim 1 and further comprising a top plate connecting the upstanding standards at the tops thereof to provide a rigid construction.

3. The merchandise display of claim 1, wherein said shelf extends rearwardly of said pair of inwardly extending flanges on said shelf.

4. The merchandise display of claim 3, wherein each of said side bottom side members has hook means at the rear end thereof for engaging the associated standard, said hook end means extending beyond the inwardly extending flange on said bottom side member.

5. The merchandise display of claim 1, wherein each of said inwardly extending flanges on said shelf has a notch therein the longitudinal extent of said notch being longer than the associated detent and the transverse extent of said notch being slightly greater than the detent so as to permit said shelf to fit over said detents and to be locked in place by sliding rearward movement of said shelf.

6. The merchandise display of claim 5, wherein each of said detents is formed in one piece from one of said upwardly extending flanges on said bottom side members.

7. The merchandise display of claim 1, wherein each of said upwardly extending flanges on said bottom side members terminates forwardly of the rear of said side members to accommodate resting of said shelf on said side members.

8. The merchandise display of claim 7, wherein said ledge on the rear of said shelf terminates inwardly from the sides of said shelf to accommodate connection of the side members to the standards.

9. The merchandise display of claim 8, wherein said ledge is U-shaped in transverse cross section.

10. The merchandise display of claim 1, wherein said shelf is constructed from a single piece of sheet metal and each of said bottom side members is constructed from a single piece of sheet metal.

* * * * *